US005204203A

United States Patent [19]

Ito et al.

[11] Patent Number: 5,204,203

[45] Date of Patent: Apr. 20, 1993

[54] ELECTROPHOTOGRAPHIC ELEMENT WITH BLOCKED ISOCYANATE BINDER

[75] Inventors: Yoshimasa Ito, Tokyo; Sohji Tsuchiya, Kanagawa; Mutsuaki Murakami, Tokyo; Atsushi Omote, Kawasaki, all of Japan

[73] Assignee: Matsushita Electric Industrial Co., Ltd., Osaka, Japan

[21] Appl. No.: 795,131

[22] Filed: Nov. 20, 1991

[30] Foreign Application Priority Data

Nov. 28, 1990 [JP] Japan ..... 2-332390

[51] Int. Cl.[5] ..... G03G 5/06

[52] U.S. Cl. ..... 430/96; 540/122

[58] Field of Search ..... 430/96, 122

[56] References Cited

U.S. PATENT DOCUMENTS

| | | | |
|---|---|---|---|
| 3,357,989 | 12/1967 | Byrne et al. | 430/78 |
| 5,017,965 | 5/1991 | Hashimoto et al. | 430/35 X |
| 5,079,117 | 1/1992 | Koyama et al. | 430/59 X |

FOREIGN PATENT DOCUMENTS

| | | | |
|---|---|---|---|
| 618993 | 4/1961 | Canada | 430/96 |
| 83744 | 7/1978 | Japan | 430/96 |
| 57-064240 | 4/1982 | Japan . | |
| 57-064243 | 4/1982 | Japan . | |
| 157251 | 9/1982 | Japan | 430/96 |
| 31338 | 2/1983 | Japan | 430/96 |
| 256148 | 12/1985 | Japan | 430/96 |
| 52162 | 2/1989 | Japan | 430/96 |

OTHER PUBLICATIONS

World Patents Index Latest Week 8221, Derwent Publications Ltd., London, GB; AN 82-42754E and JP-A-57 064 243 (Canon K.K.) Apr. 19, 1982.

*Primary Examiner*—Roland Martin

*Attorney, Agent, or Firm*—Lowe, Price, LeBlanc & Becker

[57] ABSTRACT

A photosensitive material for electrophotography, comprises a support and, provided thereon, an organic photoconductive layer of single-layer structure comprising a mixture of a metal-free phthalocyanine and a binder organic compound; said binder organic compound being comprised of an isocyanate in which the isocyanate terminal has been blocked with a blocking agent.

The present photosensitive material can achieve good sensitivity and charge characteristics and is suited for the positive charge system.

4 Claims, No Drawings

ELECTROPHOTOGRAPHIC ELEMENT WITH BLOCKED ISOCYANATE BINDER

BACKGROUND OF THE INVENTION

1. Field of the Invention

This invention relates to a photosensitive material for electrophotography, suited for a positive charge system, carried out by a process comprising static charging, exposure and developing.

2. Description of the Prior Art

Photosensitive compounds hitherto used for photosensitive materials for electrophotography include inorganic photoconductive substances and organic photoconductive substances. The former has problems on thermal stability, safety, etc. On the other hand, the latter has excellent safety and economical advantages, and are in recent years prevalent in the photosensitive materials for electrophotography. In the present invention also, the latter organic photoconductive substances are used.

Photosensitive materials or photoconductors for electrophotography (hereinafter often "OPCs") making use of such organic photoconductive substances are usually used in double-layer structure comprised of a charge-generating layer (hereinafter "CG layer") that absorbs light to generate carriers and a charge transport layer (hereinafter "CT layer") that transports the carriers generated, and it is attempted to make them more highly sensitive. In general, in the double-layer structure, the CT layer is formed on the surface side on account of strength, run length, etc., and hence the photosensitive materials are used in a negative charge system.

In such a negative charge system, however, there have been the problems that (1) deterioration due to ozone may occur because of the negative charge used for electrification, (2) the charge may be imperfect and (3) the photosensitive material tends to be affected by the properties of a drum surface.

In order to solve such problems, development is energetically being made on OPCs that employ a positive charge system. In order to accomplish the positive charge system photosensitive material, studies have been made on (1) OPCs of reverse double-layer structure in which the layer structure for the CG layer and CT layer is made reverse to the case of the negative charge system (herein "OPCs-1"), and (2) OPCs of single-layer structure in which a charge-generating agent (herein "CG agent") and a charge-transporting layer (herein "CT agent") are contained together in a single layer (herein "OPCs-2").

In the OPCs-1, however, since the CG layer, which is essentially required to be made thin, is provided on the surface side of the photosensitive material, a decrease in run length and a deterioration of lifetime characteristics are questioned. There are also the problems on the complicated production process and separation of layers that may arise from the double-layer structure. Thus this photosensitive material has not been put into practical use.

The single-layer type OPCs-2 are inferior to the OPCs-1 in respect of sensitivity and charge characteristics (repetition deterioration). In the case of the single-layer type as in OPCs-2, however, there is the advantage that a wear of the photosensitive material does not immediately result in a lowering of run length so long as the agents are uniformly dispersed. In other words, the wear of the photosensitive material is considered to have less influence on its photosensitivity characteristics. The single-layer type OPCs-2 are also advantageous in that they require not so complicated a production process as the double-layer type OPCs-1.

SUMMARY OF THE INVENTION

Under the above circumstances, an object of the present invention is to provide a single-layer type photosensitive material for electrophotography, having good sensitivity and charge characteristics and suited for the positive charge system.

To achieve the above object, the present inventors made studies from various approaches. They took note of a single-layer type OPC comprising a mixture obtained by mixing a metal-free phthalocyanine as the CG agent and a binder organic compound (an organic compound for a binder), and further continued to study the latter binder organic compound. As a result, they found that use of an isocyanate whose isocyanate terminal has been blocked can achieve a superior single-layer type OPC, and thus have accomplished the present invention.

That is to say, the photosensitive material for electrophotography according to the present invention comprises a mixture of a metal-free phthalocyanine and a binder organic compound, said binder organic compound being comprised of an isocyanate in which the isocyanate terminal has been blocked.

DESCRIPTION OF THE PREFERRED EMBODIMENTS

The isocyanate in which the isocyanate terminal has been blocked (hereinafter "blocked isocyanate") may include compounds wherein a polyisocyanate terminal has been blocked with a blocking agent of an oxime, lactam or ester type (i.e., a polyisocyanate terminal has been reacted with a blocking agent). Compounds of an oxime, lactam or ester type are suitable for the blocking agent. Those of a phenol type or acid type tend to bring about no sufficient charge potential.

The oxime type blocked isocyanate can be exemplified by Colonate 2507 (trade name), available from Nippon Polyurethane Industry Co., Ltd. The lactam type blocked isocyanate can be exemplified by Colonate 2515 (trade name), available from Nippon Polyurethane Industry Co., Ltd. The ester type blocked isocyanate can be exemplified by Colonate 2513 (trade name), available from Nippon Polyurethane Industry Co., Ltd. The phenol type blocked isocyanate can be exemplified by Colonate AP Stable (trade name), available from Nippon Polyurethane Industry Co., Ltd., and the acid type blocked isocyanate can be exemplified by Milionate MS-50 (trade name), available from Nippon Polyurethane Industry Co., Ltd.

As the binder organic compound, a polyol containing a fluorine atom (hereinafter "fluorine-containing polyol") may be used in combination with the blocked isocyanate. This can bring about an improvement in charge characteristics. The fluorine-containing polyol may include hydroxyl group-containing fluoroolefin copolymers whose main chains have been protected with fluorine.

The metal-free phthalocyanine and the binder may be in a weight ratio (as solid content) of usually from about 1:1.2 to about 1:4.5. Use of the binder in an excessively small proportion makes it difficult to obtain a sufficient charge potential. Use of the binder in an excessively large proportion makes it difficult to obtain a sufficient sensitivity.

In the case when the blocked isocyanate and the fluorine-containing polyol are used in combination, the isocyanate and the polyol may be in a weight ratio (as solid content) of usually from about 1:1 to about 9:1. Use of the fluorine-containing polyol in an excessively large proportion makes it difficult to ensure a sufficient quantity of blocked isocyanate and also makes it difficult to control the change of charge potential to a sufficiently low rate.

In the photosensitive materials for electrophotography, it is conventional to use a methacrylate together with the isocyanate and polyol (or polymers of these) as in Colonate L (trade name; available from Nippon Polyurethane Industry Co., Ltd). This is for the purpose of improving the repetition stability. The isocyanate used has a disadvantage in storage stability.

In usual instances, in combination with the binder organic compound, a solvent showing a solubility in this compound is used to make a mixture. A suitable solvent may include nitrobenzene, chlorobenzene, dichlorobenzene, dichloromethane, trichloroethylene, chloronaphthalene, methylnaphthalene, benzene, toluene, xylene, tertrhydrofuran, cyclohexanone, 1,4-dioxane, N-methylpyrrolidone, carbon tetrachloride, bromobutane, ethylene glycol, sulforan, ethylene glycol monobutyl ether, aceotoxyethane and pyridine. Any of these solvents may be used alone, or, without limitation thereto, may also be used in combination.

Thus, a mixture obtained by adding and well mixing the metal-free phthalocyanine, blocked isocyanate, fluorine-containing polyol, solvent and so forth is coated on the surface of a substrate such as a drum or belt by means of a bar coater, a calender coater, a spin coater, a blade coater, a dip coater or a gravure coater, followed by heat treatment to effect curing. The heat-cured film thus completed is the main component of the photosensitive material for electrophotography.

In the OPC of the present invention, use of an X-type metal-free phthalocyanine as the CG agent brings about a particularly good result. In such an instance, particularly preferred is an embodiment in which the mixture contains a particulately dispersed X-type phthalocyanine and a molecularly dispersed phthalocyanine.

The phthalocyanine can be grouped into a metal phthalocyanine having a metal atom in its center and a metal-free phthalocyanine having no metal atom. The latter metal-free phthalocyanine (hereinafter "H2-Pc") is hitherto known to typically include two kinds of phthalocyanine, an $\alpha$-type and a $\beta$-type.

In this regard, Xerox Corporation has developed an X-type H2-Pc having a superior electrophotographic performance, and has made researches on its synthesis method, its relationship between crystal forms and electrophotographic performance, and its structural analyses (see U.S. Pat. No. 3,357,989). The X-type H2-Pc can be produced by converting a $\beta$-type H2-Pc synthesized by a conventional method, to the $\alpha$-type by subjecting it to a sulfuric acid treatment, followed by ball milling for a long period of time. Its crystal structure is clearly different from the conventional $\alpha$-types and $\beta$-types. The X-ray diffraction pattern of the X-type H2-Pc shows that its diffracted beams appear at $2\theta=7.4$, 9.0, 15.1, 16.5, 17.2, 20.1, 20.6, 20.7, 21.4, 22.2, 23.8, 27.2, 28.5 and 30.3 (unit: °). A diffracted beam with a highest intensity is the diffracted beam in the vicinity of 7.5° (corresponding to the spacing d=11.8Å). Assuming its intensity as 1, the diffracted beam intensity in the vicinity of 9.1° (corresponding to the spacing d=9.8Å) is 0.66.

The X-type H2-Pc and the binder organic compound are added to the solvent, and then mixed with stirring (or kneaded) to effect dispersion. As a result of thorough mixing with stirring, the X-type H2-Pc is brought into fine particles and, at the same time, part thereof is solubilized (considered to have been solubilized on account of the fact that the viscosity has increased). The molecularly dispersed H2-Pc different from the particulately dispersed X-type H2-Pc is considered to have been produced in the resulting mixture. Then it can be presumed that the presence of the molecularly dispersed H2-Pc has brought about the function of charge transport. In the case when the X-type H2-Pc is used in combination, the X-ray diffraction pattern is clearly different from the diffraction pattern of the X-type H2-Pc used alone, and is clearly different also from the diffraction patterns of the $\alpha$-type and $\beta$-type H2-Pc's. More specifically, in its X-ray diffraction pattern, the diffracted beams with $2\theta$ of 21.4° or more tend to disappear and the diffracted beam in the vicinity of 16.5° tend to increase, compared with the X-ray diffraction pattern of the X-type H2-Pc. A most distinctive change is that only the diffracted beam in the vicinity of 7.5° among the most characteristic diffracted beams of the H2-Pc, i.e., the two diffracted beams in the vicinity of 7.5° (d=11.8 Å) and in the vicinity of 9.1° (d=9.8 Å) has selectively disappeared. From these facts, it can be presumed that at least part of the X-type H2-Pc has changed to something new.

Degree of the mixing with stirring (usually, stirring for a day or more is necessary), time, temperature, etc. may vary depending on the solvent, etc. to be used. A suitable degree of treatment can be found on the basis of ratio ($I_{11.8}/I_{9.8}$) of the diffracted beam intensity in the vicinity of 7.5° and the diffracted beam intensity in the vicinity of 9.1° of the X-ray diffraction pattern described above. This ratio may preferably be controlled to range from 1 to 0.1.

As described above, the H2-Pc, blocked isocyanate alone, or together with fluorine-containing polyol, and solvent are put together and mixed by the method making use of a ball mill, an attritor, a sand mill, a sand grinder or the like, followed by coating and then heating to form a heat-cured film.

In the course of the mixing treatment, the phthalocyanine is partially solubilized and at the same time formed into fine particles with progress of the treatment, and brought into an appropriately dispersed state. Furthermore, its viscosity more increases and the absorbance of the film formed becomes better with progress of the treatment. Although the reason why the absorbance becomes better is not clear, it is presumed that mutual action takes place between the X-type phthalocyanine solubilized during the mixing treatment and the binder organic compound.

It is also possible to similarly use an X-type H2-Pc that little undergoes such mutual action.

An H2-Pc having a crystal form other than the above X-type H2-Pc may also include a $\tau$-type H2-Pc. This can be obtained by subjecting $\alpha$, $\beta$ and X-type crystals to ball milling in an inert solvent together with a grinding aid at 5° to 10° C. for 20 hours. Its X-ray diffraction pattern is fundamentally similar to that of the X-type H2-Pc. In this instance, however, the ratio of the diffracted beam intensity in the vicinity of 7.5° to the diffracted beam intensity in the vicinity of 9.1° is 1:0.8. This τ-type H2-Pc can also be used in the same way as the X-type H2-Pc.

The photosensitive material for electrophotography according to the present invention can be used in recording machinery as exemplified by copying machines, printers and facsimile apparatus. It may also be used in other purpose.

The structure of the OPC of the present invention is not limited to what is exemplified in the above. The OPC may also have a structure wherein a surface protective layer formed of an insulating resin is laminated to the heat-cured film, or a blocking layer is provided between the photosensitive layer and the substrate.

In the photosensitive material for electrophotography according to the present invention, an isocyanate type organic compound is used as a binder, and hence it can achieve good charge characteristics and sensitivity characteristics. Since this isocyanate type organic compound is a blocked isocyanate, a satisfactory stability can be achieved, e.g., the rate of change in charge potential can be small after charging has been repeatedly operated.

The photosensitive material for electrophotography according to the present invention is of a single-layer type, and hence it has the advantages that the complicated production process can be avoided and the run length can be superior. Moreover, since the positive charge system can be applied, the difficulties such as ozone deterioration occurring in the case of the negative charge system can be eliminated.

Since also the CT agent, having a weakness to heat, can be omitted when the metal-free X-type phthalocyanine is used, the present invention can bring about an improvement in heat stability.

EXAMPLE

Examples of the photosensitive material for electrophotography of the present invention will be described below, starting from the stage of production. Needless to say, the present invention is by no means limited to the following Examples.

EXAMPLE 1

An X-type metal-free phthalocyanine (Fastogen Blue 8120B, trade name; available from Dainippon Ink & Chemicals, Incorporated) and a blocked isocyanate (Colonate 2507, trade name; available from Nippon Polyurethane Industry Co., Ltd.) were used in a weight ratio of 1:3.5 (solid content). Tetrahydrofuran was used as a solvent.

First, at room temperature, the solvent and blocked isocyanate were put in a ball mill container in a proportion of 2:3. Thereafter the space portion of the container was substituted with dry air, and then the container was closed. After stirring for about 2 hours, Fastogen Blue was added, and the space portion was similarly substituted with dry air, followed by stirring for 24 hours. Then the resulting solution was coated on an aluminum substrate by means of a bar coater, followed by heat treatment (drying) at 150° C. for 3 hours to give a single-layer type OPC.

EXAMPLE 2

A single-layer type OPC was obtained in the same manner as in Example 1 except that Colonate 2513 was used as the blocked isocyanate.

EXAMPLE 3

A single-layer type OPC was obtained in the same manner as in Example 1 except that Colonate 2515 was used as the blocked isocyanate and the heat treatment was carried out at 160° C. for 4 hours.

COMPARATIVE EXAMPLE 1

A single-layer type OPC was obtained in the same manner as in Example 1 except that the blocked isocyanate was replaced with a usual toluene diisocyanate, 2,4-tolylene diisocyanate (Colonate T-65, trade name; available from Nippon Polyurethane Industry Co., Ltd.) and the heat treatment was carried out at 120° C. for 3 hours.

COMPARATIVE EXAMPLE 2

A single-layer type OPC was obtained in the same manner as in Example 1 except that the blocked isocyanate was replaced with diphenylmethane-4,4'-diisocyanate (Milionate MT, trade name; available from Nippon Polyurethane Industry Co., Ltd.) and the heat treatment was carried out at 120° C. for 3 hours.

COMPARATIVE EXAMPLE 3

A single-layer type OPC was obtained in the same manner as in Example 1 except that the blocked isocyanate was replaced with polymethylene-polyphenylpolyisocyanate (Milionate MR, trade name; available from Nippon Polyurethane Industry Co., Ltd.) and the heat treatment was carried out at 120° C. for 3 hours.

COMPARATIVE EXAMPLE 4

A single-layer type OPC was obtained in the same manner as in Example 1 except that the blocked isocyanate was replaced with a modified isocyanate, a reacton product of trimethylol propane with 2,4-tolylene diisocyanate (Colonate L, trade name; available from Nippon Polyurethane Industry Co., Ltd.) and the heat treatment was carried out at 120° C. for 3 hours.

Photosensitivity characteristics of the OPCs obtained in Examples 1 to 3 and and Comparative Examples 1 to 4 were examined. For the measurement, a paper analyzer EPA-8100 Type, manufactured by Kawaguchi Denki K. K. was used. Each OPC brought into a positively charged state was irradiated with white light using a tungsten lamp, and the rate of change in charge potential with respect to the initial charge potential was determined after charging operation was repeated 1,000 times. Results obtained are shown in Table 1.

TABLE 1

| | Rate of charge potential change |
|---|---|
| Example 1: | 7% |
| Example 2: | 11% |
| Example 3: | 6% |
| Comparative Example 1: | 40% |
| Comparative Example 2: | 38% |
| Comparative Example 3: | 33% |
| Comparative Example 4: | 28% |

It is well understood from the results shown in Table 1 that use of the blocked isocyanate can bring about a remarkable improvement of repetition performance.

EXAMPLE 4

A single-layer type OPC was obtained in the same manner as in Example 1 except that Fastogen Blue and Colonate 2507 were used in a weight ratio of 1:1.2 and the heat treatment was carried out at 140° C. for 4 hours.

EXAMPLE 5

A single-layer type OPC was obtained in the same manner as in Example 1 except that Fastogen Blue and Colonate 2507 were used in a weight ratio of 1:3.0 and the heat treatment was carried out at 140° C. for 4 hours.

EXAMPLE 6

A single-layer type OPC was obtained in the same manner as in Example 1 except that Fastogen Blue and Colonate 2507 were used in a weight ration of 1:4.5 and the heat treatment was carried out at 140° C. for 4 hours.

Photosensitivity characteristics of the OPCs obtained in Examples 4 to 6 were examined. For the measurement, a paper analyzer EPA-8100 Type, manufactured by Kawaguchi Denki K. K. was used. Each OPC brought into a positively charged state was irradiated with white light using a tungsten lamp, and the charge potential and photosensitivity were determined. The photosensitivity was measured as half decay exposure, $E_{178}$. Results obtained are shown in Table 1.

TABLE 2

| | Charge potential (V) | Photosensitivity (lux · sec) |
|---|---|---|
| Example 4: | 730 | 1.6 |
| Example 5: | 780 | 2.0 |
| Example 6: | 800 | 3.1 |

It is well understood from Table 2 that good charge potential and photosensitivity characteristics can be obtained when the metal-free phthalocyanine and the blocked isocyanate are used in a weight ratio of from 1:1.2 to 1:4.2. Meanwhile, it was also confirmed that their use in a weight ration less than 1:1.2 (for example, 1:0.8) tended to bring about an insufficient charge potential and their use in a weight ration more than 1:4.5 (for example, 1:5.5) tended to bring about an insufficient photosensitivity. These tendencies were similarly seen when Colonate 2513 or 2515 was used.

EXAMPLE 7

Fastogen Blue and binders, Colonate 2515 and Fluonate K-700 (trade name; a fluorine-containing polyol, hydroxyl group-containing fluorine resin, available from Dainippon Ink & Chemicals, Incorporated) were used in a weight ration of 1:3 (solid content). Colonate 2515 and Fluonate K-700 were in a weight ration of 5:5. Tetrahydrofuran was used as a solvent.

First, in a glass container with a stirrer, the solvent and binders were put to hold the whole quantity. After stirring for about 3 hours, Fastogen Blue was added, followed by stirring for 24 hours. Then the resulting solution was coated on an aluminum substrate by dip coating, followed by heat treatment (drying) at 140° C. for 4 hours to give a single-layer type OPC.

EXAMPLE 8

A single-layer type OPC was obtained in the same manner as in Example 7 except that Colonate 2515 and Fluonate K-700 were used in a weight ration of 7:4.

EXAMPLE 9

A single-layer type OPC was obtained in the same manner as in Example 7 except that Colonate 2515 and Fluonate K-700 were used in a weight ratio of 9:1.

EXAMPLE 10

A single-layer type OPC was obtained in the same manner as in Example 7 except that Colonate 2515 was used to hole the whole quantity (i.e., no Fluonate K-700 was used).

EXAMPLE 11

A single-layer type OPC was obtained in the same manner as in Example 7 except that Colonate 2515 and Fluonate K-700 were used in a weight ratio of 4:6.

The rate of change in charge potential was determined in the same manner as in Example 7 except that charging operation was repeated 2,000 times. Results obtained are shown in Table 3.

TABLE 3

| | Rate of charge potential change |
|---|---|
| Example 7: | 7% |
| Example 8: | 8% |
| Example 9: | 8% |
| Example 10: | 10% |
| Example 11: | 18% |

It is well understood from Table 3 that use of the fluorine-containing polyol in appropriate combination can be effective for improving the rate of change in charge potential. An increase in the amount of the fluorine-containing polyol result in a loss of the effect of improving the rate of change in charge potential (Example 11). The photosensitivity and charge potential were also measured to obtain good results.

As having been described above, the single-layer type photosensitive material for electrophotography is comprised of the metal-free phthalocyanine and the organic compound capable of acting as a suitable binder, and hence can have good sensitivity and charge characteristics, can be produced through a not so complicated process, can be superior in run length, and also can be applied to the positive charge system, bringing about a very high practical utility.

What is claimed is:

1. A photosensitive material for electrophotography, comprising a support and, provided on the support, an organic photoconductive layer of single-layer structure comprising a mixture of a metal-free phthalocyanine and a binder organic compound; said binder organic compound consisting essentially of an isocyanate in which the isocyanate terminal has been blocked with a blocking agent selected from the group consisting of an oxime compound, a lactam compound and an ester compound.

2. A photosensitive material for electrophotography according to claim 1, wherein said metal-free phthalocyanine and said binder are in a weight ratio of from 1:1.2 to 1:4.5.

3. A photosensitive material for electrophotography according to claim 1, wherein said metal-free phthalocyanine comprises X-type metal-free phthalocyanine.

4. A photosensitive material for electrophotography, comprising a support and, provided on the support, an organic photoconductive layer of single-layer structure comprising a mixture of a metal-free phthalocyanine and a binder organic compound; said binder organic compound consisting essentially of an isocyanate in which the isocyanate terminal has been blocked with a blocking agent selected from the group consisting of an oxime compound, a lactam compound and an ester compound, and a fluorine-containing polyol, the weight ratio of the isocyanate and the polyol being from 1:1 to 9:1.

* * * * *